United States Patent [19]

Jackson

[11] Patent Number: 4,934,020

[45] Date of Patent: Jun. 19, 1990

[54] CHARGING UNIT AND VACUUM CLEANER

[75] Inventor: William B. Jackson, Hamden, Conn.

[73] Assignee: Black & Decker Inc., Newark, Del.

[21] Appl. No.: 294,618

[22] Filed: Jan. 9, 1989

[51] Int. Cl.[5] ..... A47L 5/24

[52] U.S. Cl. ..... 15/339; 15/344; 320/2

[58] Field of Search ..... 15/339, 344; 320/2

[56] References Cited

U.S. PATENT DOCUMENTS 4,209,875 7/1980 Pugh et al. .
4,225,814 9/1980 Gantz et al. ..... 15/DIG. 1
4,306,558 12/1981 Kurtz et al. .
4,542,557 9/1985 Levine .
4,573,234 3/1986 Kochte et al. .
4,610,048 9/1986 Ishihara et al. .
4,665,582 5/1987 Richmond et al. .
4,670,701 6/1987 Sako et al. ..... 15/DIG. 1

*Primary Examiner*—Chris K. Moore
*Attorney, Agent, or Firm*—Barry E. Deutsch

[57] ABSTRACT

The present invention is a vacuum cleaner and recharging assembly including a vacuum cleaner having a motor, a housing enclosing the motor, a fan driven by the motor for producing a vacuum, a canister for at least the reception of air and foreign matter drawn into the canister in response to the vacuum produced by the fan, and a power source for powering the motor. The assembly also includes a charging unit cooperable with the vacuum cleaner for charging the power source. The assembly further includes means for removably securing the vacuum cleaner to the charging unit when the vacuum cleaner engages the charging unit.

7 Claims, 5 Drawing Sheets

FIG. 3
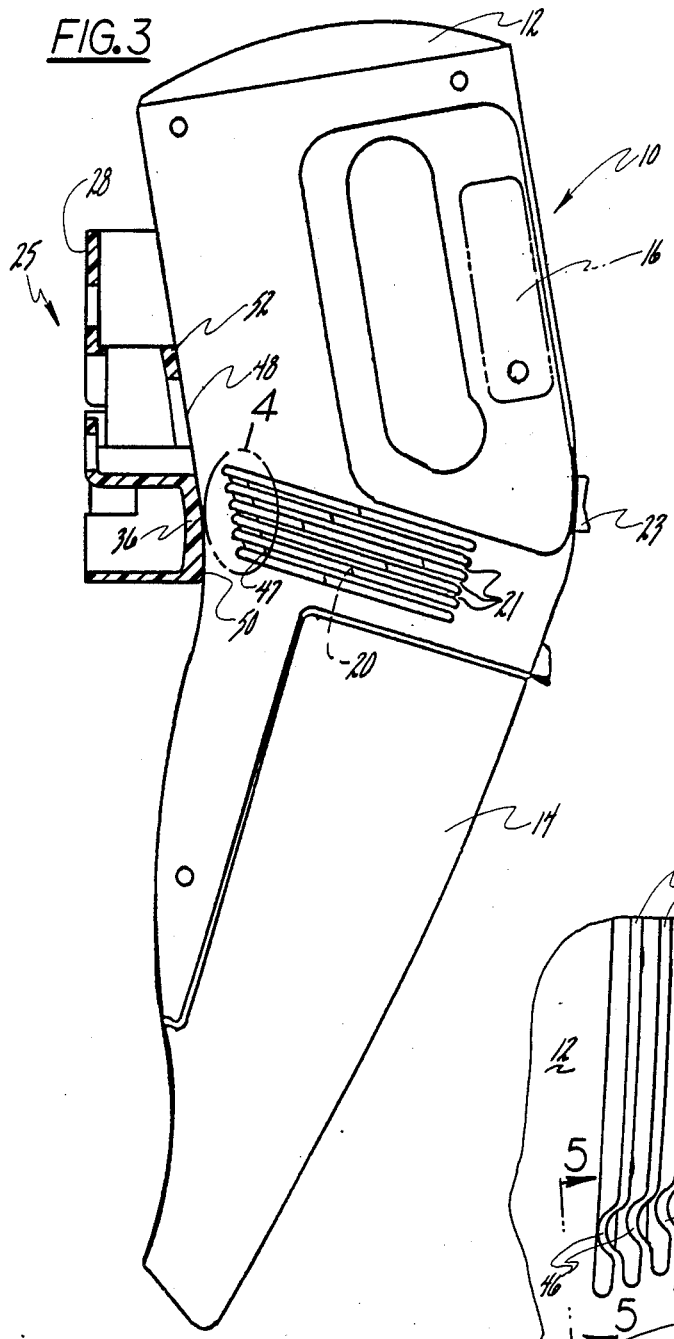
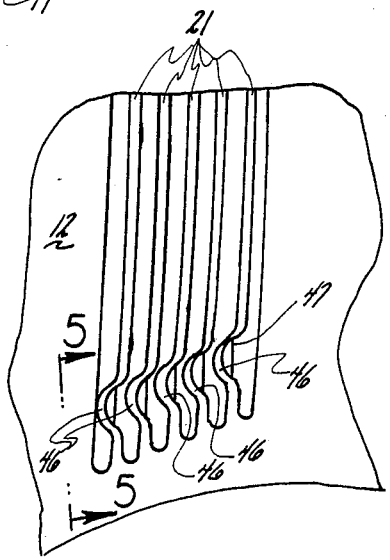
FIG. 4

FIG. 5
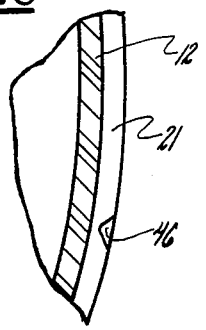
FIG. 6
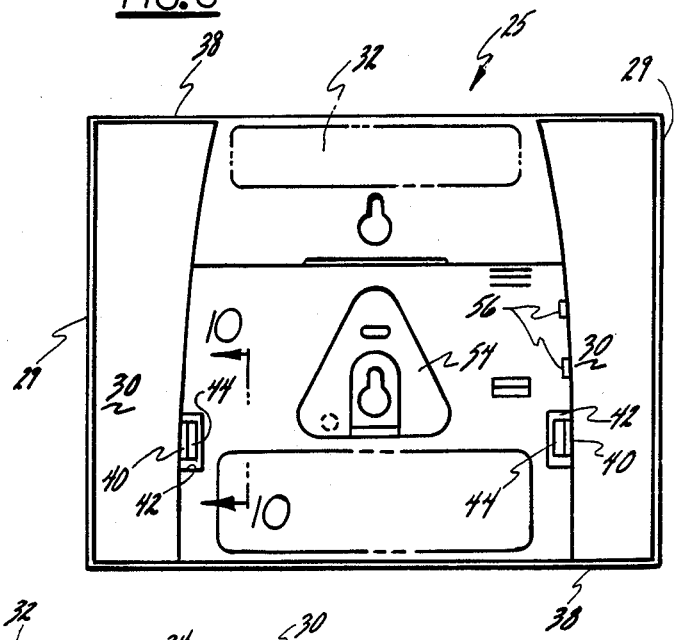
FIG. 7
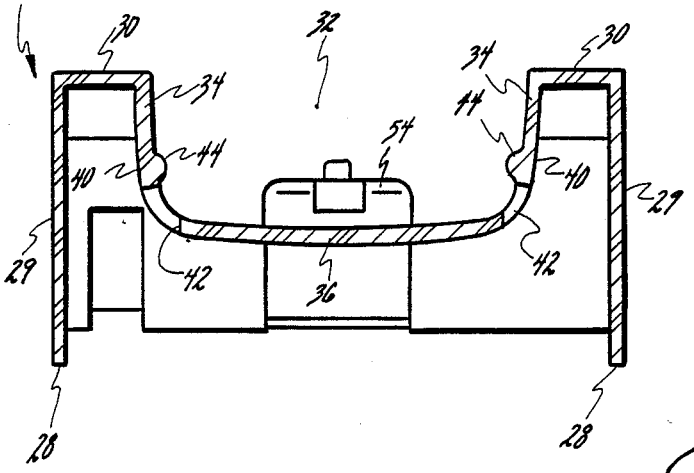
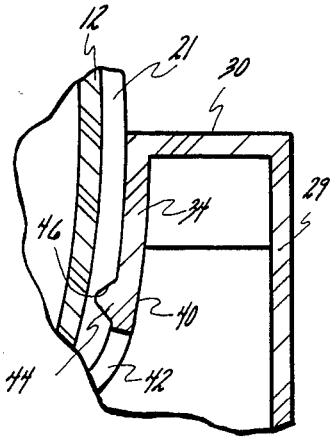
FIG. 8

CHARGING UNIT AND VACUUM CLEANER

BACKGROUND OF THE INVENTION

1. Field of the Invention

The present invention relates generally to portable vacuum cleaners, more particularly to, a vacuum cleaner capable of operating with both air and liquid.

2. Description of Related Art

Currently, there exists portable vacuum cleaners which pick up or vacuum solid or liquid material. These portable vacuum cleaners are frequently referred to as "wet-dry" vacuum cleaners. Conventionally, the power source of such vacuum cleaners is charged by a charging unit. The vacuum cleaner is placed on the charging unit which rests on a generally horizontal or flat support surface. The charging unit includes a pair of charging contacts to engage a corresponding pair of contacts on the vacuum cleaner to allow electrical power to flow from the charging unit to the power source of the vacuum cleaner.

One disadvantage of the above charging unit is that when the charging unit is not mounted, the operator has to use both hands to remove the vacuum cleaner from the charging unit without the charging unit being moved or tipped. This is undesirable and limits the flexibility of the operator having a hand free for another task.

Another disadvantage of the above charging unit is that when the vacuum cleaner is removed and the charging unit is not secured to a mounting or support surface, the charging unit may move and scratch or mar the mounting or support surface.

It is, therefore, one object of the present invention to provide one hand removal of the vacuum cleaner from the charging unit.

It is another object of the present invention to keep the charging unit stationary while removing the vacuum cleaner to prevent scratching or marring of the mounting surface, even when the charging unit is not anchored to the mounting surface.

SUMMARY OF THE INVENTION

Accordingly, the present invention is a vacuum cleaner and recharging assembly including a vacuum cleaner having a motor, a housing enclosing the motor, a fan driven by the motor for producing a vacuum, a canister for at least the reception of air and foreign matter drawn into the canister in response to the vacuum produced by the fan, and a power source for powering the motor. The assembly also includes a charging unit cooperable with the vacuum cleaner for charging the power source. The assembly further includes means for removably securing the vacuum cleaner to the charging unit when the vacuum cleaner engages the charging unit.

One advantage of the present invention is that the vacuum cleaner may be removed from the charging unit with only one hand of the operator. Another advantage of the present invention is that the charging unit will remain stationary and not scratch the mounting surface when the vacuum cleaner is removed from the non-anchored charging unit. A further advantage of the present invention is that the vacuum cleaner is removably secured to the charging unit when the charging unit is mounted on a wall or the like.

Other advantages of the present invention will be readily appreciated as the same becomes better understood by reference to the following detailed description when considered in connection with the accompanying drawings.

BRIEF DESCRIPTION OF THE DRAWINGS

FIG. 3 is a sectional view of the charging unit of FIG. 2 with the vacuum cleaner removably secured to the charging unit.

FIG. 4 is a partial perspective view of a portion circled in FIG. 3.

FIG. 5 is a sectional view taken along line 5—5 of FIG. 4.

FIG. 6 is a plan view of the charging unit of FIG. 2.

FIG. 7 is a sectional view taken along line 7—7 of FIG. 2.

FIG. 8 is an enlarged view of a right corner portion of FIG. 7 with the vacuum cleaner removably secured to the charging unit.

DESCRIPTION OF THE PREFERRED EMBODIMENT

Figure 1:
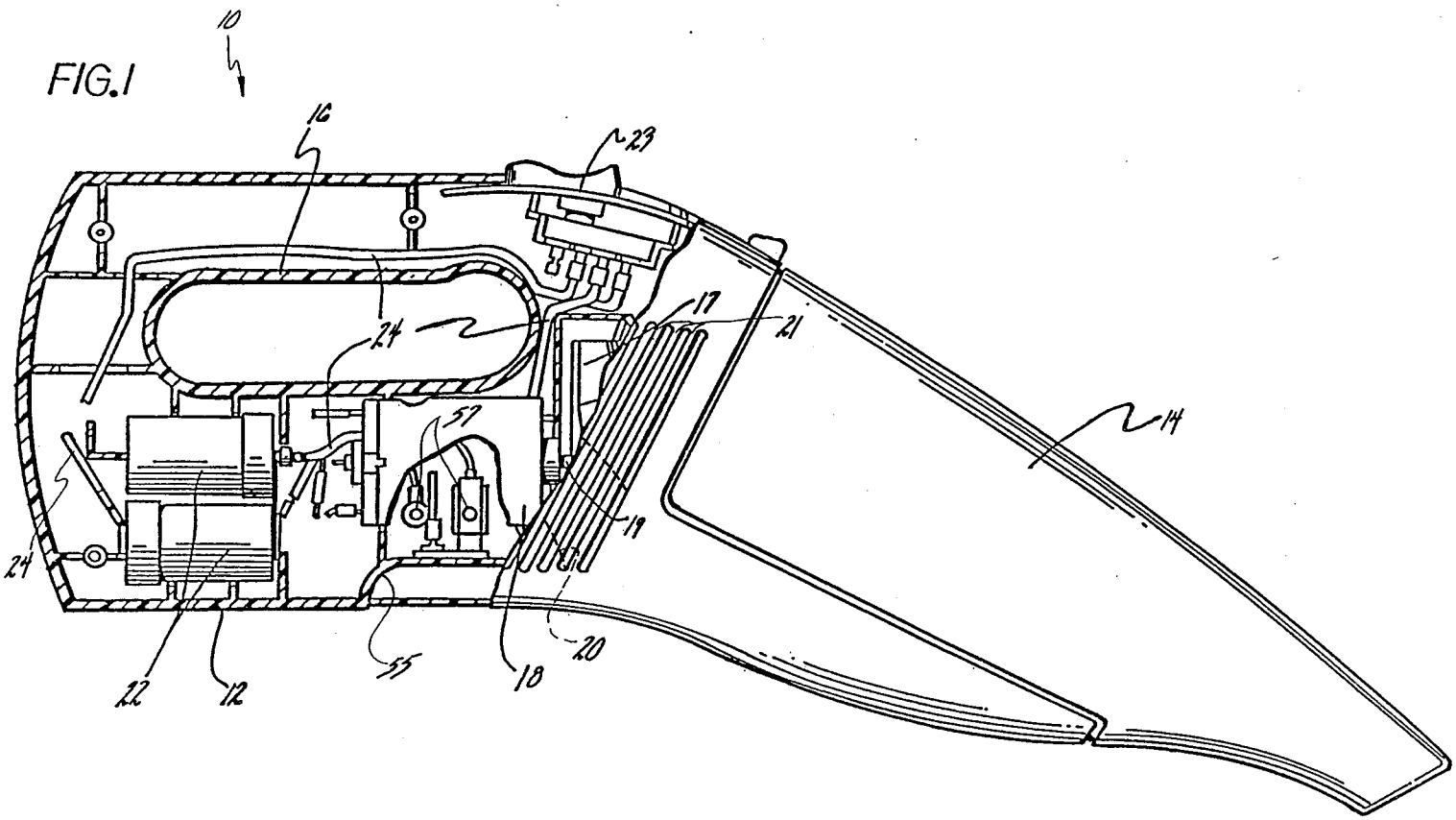
FIG. 1 is an elevational view with a portion broken away of a vacuum cleaner according to the present invention.

Referring to FIG. 1, a vacuum cleaner 10 according to the present invention is shown. The vacuum cleaner 10 comprises a central housing 12 having a canister 14 affixed to a front end thereof and a handle 16 formed near the back end thereof. The handle 16 is configured to be grasped by the hand of a person using the vacuum cleaner 10 for the cleaning of upholstery, rugs, as well as in the dusting of flat surfaces such as the top of a table.

The housing 12 contains a source of suction or fan 17 which may also be referred to as a blower or impeller, and an electric motor 18 coupled by a shaft 19 to the fan 17. Rotation of the shaft 19 by the motor 18 imparts rotation to the fan 17 to create a partial vacuum and the accompanying suction which draws air and foreign matter into the canister 14. The air exits the housing 12 through a side aperture 20 which is covered by a plurality of spaced fins 21.

The motor 18 of the vacuum cleaner 10 is powered by a power source comprising at least one, preferably, a plurality of batteries 22. A switch 23 is positioned on the upperside of the handle 16 for convenient engagement by means of the thumb of a person utilizing the vacuum cleaner 10. Operation of the switch 23 provides for the coupling of electric power from the batteries 22 to the motor 18 for activation of the motor 18. Electric wiring 24 connects the batteries 22 via the switch 23 to the motor 18.

Figure 2:
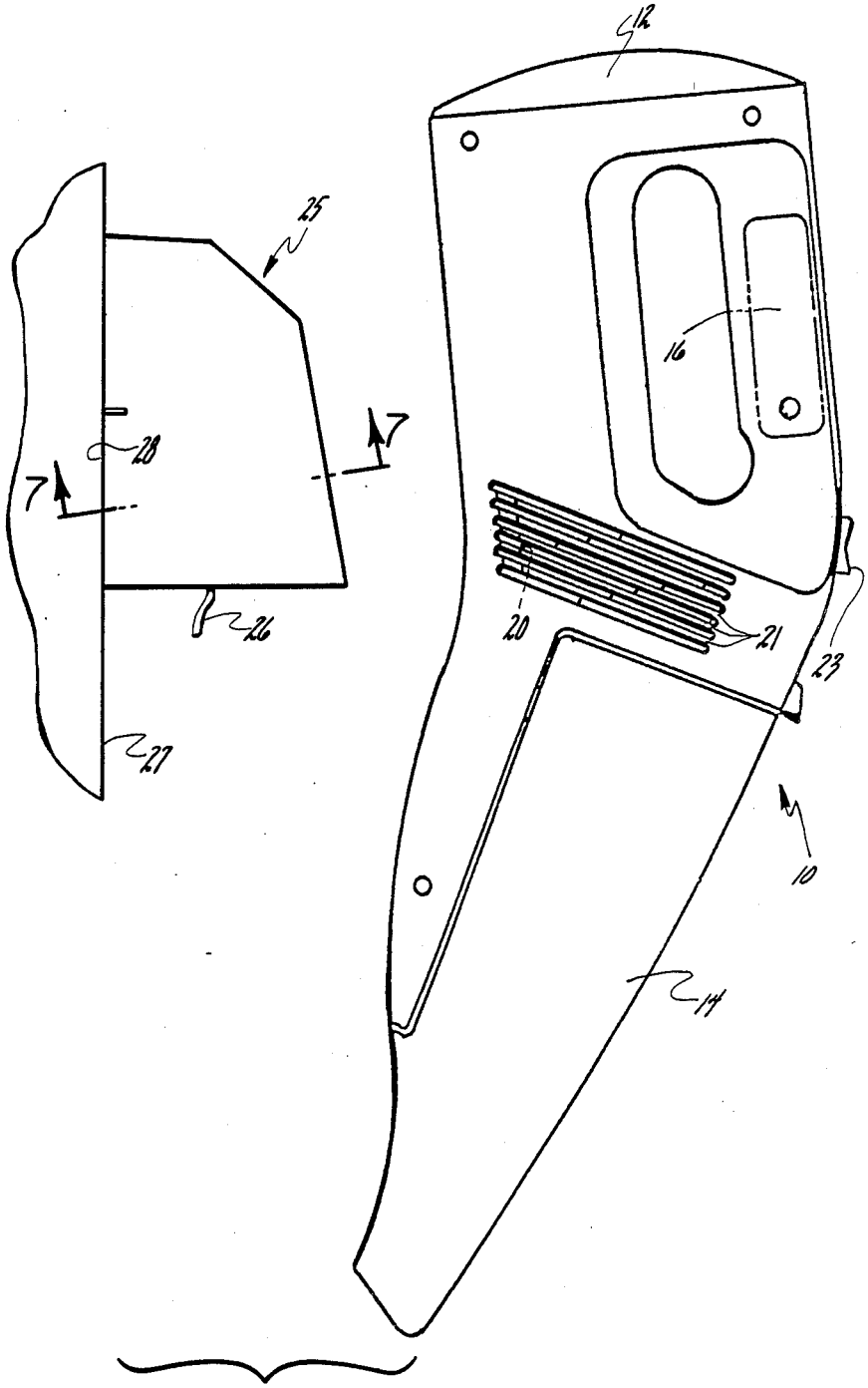
FIG. 2 is an exploded elevational view of a vacuum cleaner and charging unit incorporating the present invention.

Referring to FIG. 2, a charging unit 25 for charging the batteries or power source 22 during a period of non-use of the vacuum cleaner 10 is shown. The charging unit 25 is connected by a suitable electric cord 26 (partially shown) to an electrical convenience power outlet in the home or other location where the vacuum cleaner 10 is to be stored. It should be appreciated that the charging unit 25 may be secured to a vertical or horizontal support or mounting surface 27 by means of fasteners or the like.

Figure 10:
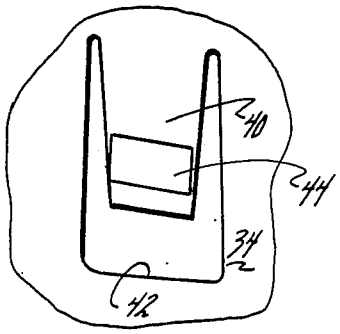
FIG. 10 is a sectional view taken along line 10—10 of FIG. 6.

The charging unit 25 is generally rectangular in shape and has a bottom 28 adapted to be supported by the support surface 27. Referring to FIGS. 6 and 7, a pair of side walls 29 extend upwardly from the bottom 28. A generally horizontal upper wall 30 extends inwardly from each side wall 29. A generally U-shaped cavity 32, in cross-section, is formed by downwardly depending side walls 34 from the upper walls 30 to a generally horizontal bottom wall 36. The cavity 32 extends axially through the end walls 38 of the charging unit 25. A locking tab 40 is formed in each side wall 34 of the cavity 32 and extends downwardly in a corresponding aperture 42 formed about the locking tab 40 in the side wall 34 as illustrated in FIG. 10. The locking tab 40 has a protrusion 44 extending inwardly into the cavity 32 at the freely depending end thereof.

The charging unit 25 is made of a plastic material. As such, the locking tab 40 has some degree of flexibility to permit deflection and has resiliency to return to its undeflected position. As illustrated in FIG. 8, the protrusion 44 is adapted to be disposed or slidingly fit into corresponding grooves 46 formed in the housing 12 of the vacuum cleaner 10. The grooves 46 extend inwardly into the fins 18 of the housing 12 as illustrated in FIGS. 4 to form a recess, generally indicated at 47.

Referring to FIG. 3, the bottom wall 36 has a first upper surface 48 which is inclined and a second upper surface 50 which is generally arcuate. The first and second upper surfaces 48 and 50 are inclined relative to each other. The first upper surface 48 has an end 52 which acts as a pivot point for removing the vacuum cleaner 10 from the charging unit 25 as will be described subsequently.

The charging unit 25 includes a pedestal 54 which is generally triangular in shape and is disposed in a corresponding cavity 55 formed in the housing 12 of the vacuum cleaner when the vacuum cleaner 10 engages the charging unit 25 for charging of the batteries 22. The charging unit 25 includes a pair of contact strips 56 in one of the side walls 34 which contact a corresponding pair of contacts 57 (FIG. 1) on one side of the housing 12 which are electrically connected to the batteries 22 to permit electrical charging contact of the batteries 22.

In operation, when the batteries or power source 22 of the vacuum cleaner 10 need to be charged, the vacuum cleaner 10 is disposed in the cavity 32 of the charging unit 25 such that the bottom surface of the housing 12 rests on the bottom wall 36 of the cavity 32. The locking tabs 40 deflect outwardly and return to their undeflected position such that the protrusions 44 are disposed or slidingly fit into the grooves 46 of the recess 47 in the housing 12. The pedestal 54 is disposed within the corresponding cavity 55 of the housing 12. The charging contacts 57 and strips 56 engage each other to complete an electrical circuit to allow power to flow from an external power source through the charging unit 25 to the batteries or power source 22 of the vacuum cleaner 10.

Figure 9:
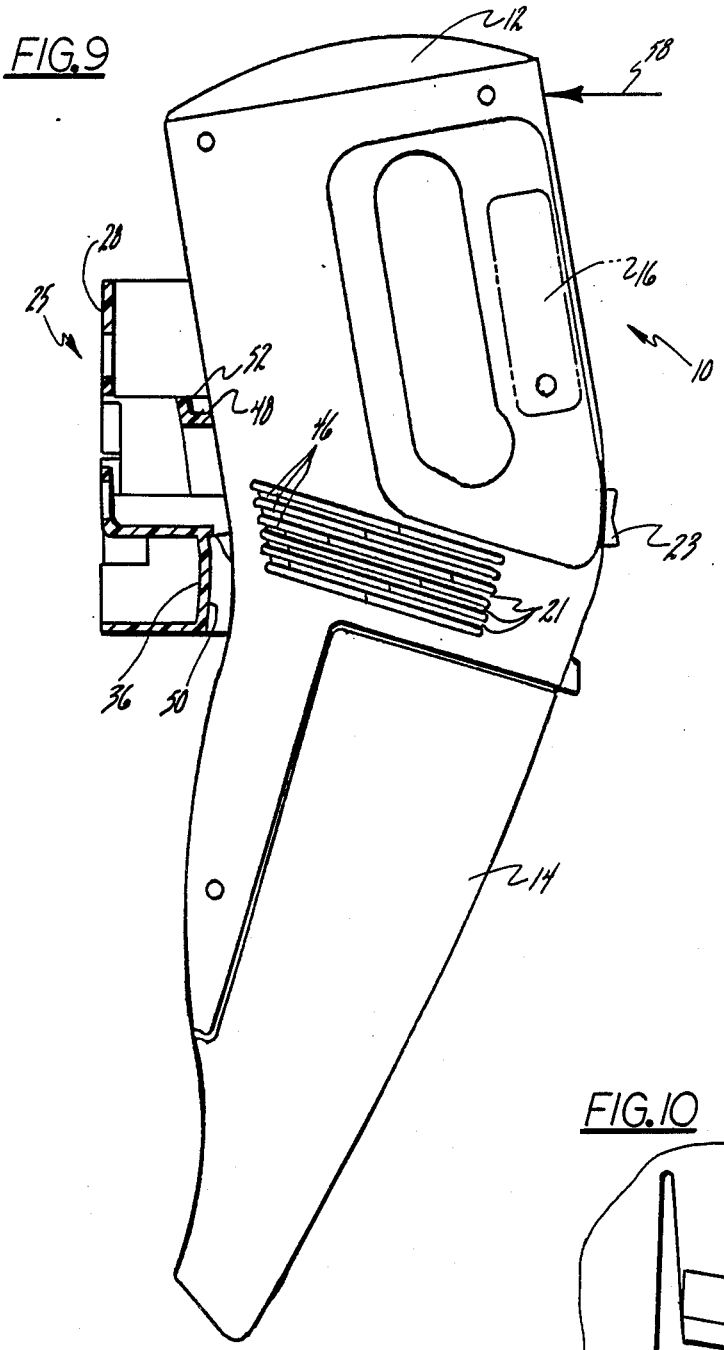
FIG. 9 is an elevational view of the vacuum cleaner and charging unit with the vacuum cleaner having the handle portion lowered as a first step for removal from the charging unit.

Referring to FIG. 9, when the vacuum cleaner 10 is desired to be removed, a force 58 is applied downwardly by the hand of a person when grasping the handle 16 to the rearward end of the housing 12. This causes the vacuum cleaner 10 to lever or pivot about end 52 of the bottom wall 36 of the charging unit 25 which acts as a lever or pivot point. As a result, the protrusions 44 are deflected outwardly and disengage the grooves 46 of the recess 47 in the housing 12. The forward end of the housing 12 separates or lifts off the second upper surface 50 of the bottom wall 36. Since the locking tabs 40 are disengaged, the vacuum cleaner 10 may be freely removed from the charging unit 25 without displacing or moving the charging unit 25. This above method of removal is referred to as a "rocking method" of removing the vacuum cleaner 10 from the charging unit 25.

The present invention has been described in an illustrative manner. It is to be understood that the terminology which has been used is intended to be in the nature of words of description rather than of limitation.

Obviously, many modifications or variations of the present invention are possible in light of the above teachings. Therefore, within the scope of the appended claims, the present invention may be practiced otherwise than as specifically described.

What is claimed is:

1. A vacuum cleaner and charging assembly comprising:

a vacuum cleaner including a motor, a housing enclosing said motor, and a power source for powering said motor, said housing including means forming a groove extending inwardly from the outer surface of said housing on each side thereof;

a charging unit cooperable with said vacuum cleaner for charging said power source, said charging unit including means forming a cavity extending axially through said unit, said cavity including a bottom wall and upwardly extending sidewalls from said bottom wall, said bottom and said sidewalls having a shape complementary to the outer surface of said housing;

means for removably securing said vacuum cleaner to said charging unit when said vacuum cleaner engages said charging unit; and each of said sidewalls of said charging unit including a locking tab pivotably connected at one end and being movable between a first position in which the free end of said locking tab engages said groove and a second position in which the free end of said locking tab disengages said groove.

2. An assembly as set forth in claim 1 wherein said bottom wall has a first portion and a second portion, said first and second portions being inclined relative to each other.

3. An assembly as set forth in claim 2 wherein the bottom surface of said housing has a third portion complementary to said first portion and a fourth portion complementary to said second portion.

4. An assembly as set forth in claim 3 wherein said charging unit includes a bottom surface adapted to be supported by a support surface.

5. An assembly as set forth in claim 4 wherein said charging unit includes means extending upwardly from said bottom surface for supporting said bottom wall in spaced relation thereto.

6. An assembly as set forth in claim 5 wherein said said bottom wall forms a pivot point at one end to allow said third portion of said housing to disengage from said first portion of said bottom wall when said vacuum cleaner is pivoted by an operator to move said locking tabs to said second position.

7. A vacuum cleaner and charging assembly comprising:

a vacuum cleaner including a motor, a housing enclosing said motor, a fan driven by said motor for producing a vacuum, a canister for at least the reception of air and foreign matter drawn into said canister in response to the vacuum produced by said fan, and a power source for powering said motor;

a charging unit cooperable with said vacuum cleaner for charging said power source;

means for removably securing said vacuum cleaner to said charging unit when said vacuum cleaner engages said charging unit;

said charging unit including a bottom wall and upwardly extending side walls from said bottom wall to form a cavity, said bottom and said side walls having a shape complementary to the outer surface of said housing;

said housing including means forming a groove extending inwardly from the outer surface of said housing on each side thereof;

each of said side walls of said charging unit including a locking tab pivotally connected at one end and being moveable between a first position in which the free end of said locking tab engages said groove and a second position in which the free end of said locking tab disengages said groove; and said bottom wall forming a pivot point at one end to allow a bottom surface of said housing to disengage from said bottom wall when said vacuum cleaner is pivoted by an operator to move said locking tabs to said second position and allow removal of said vacuum cleaner from said charging unit.

* * * * *